United States Patent [19]

Amesso et al.

[11] 4,432,177

[45] Feb. 21, 1984

[54] BUILDING BLOCK FOR FLOORS AND WALLS OF A BUILDING

[75] Inventors: Claudio Amesso, Monza; Paolo Donaggio, Salò, both of Italy

[73] Assignee: Industrie Pirelli, Milan, Italy

[21] Appl. No.: 318,931

[22] Filed: Nov. 6, 1981

[30] Foreign Application Priority Data

Nov. 6, 1980 [IT] Italy ..... 25800 A/80

[51] Int. Cl.[3] ..... E04F 13/02

[52] U.S. Cl. ..... 52/309.17; 52/388; 52/389

[58] Field of Search ..... 52/309.17, 388, 389, 52/318; 264/45; 428/86

[56] References Cited

U.S. PATENT DOCUMENTS 3,335,048 8/1967 Morain ..... 52/389 X 3,521,418 7/1970 Bartoloni ..... 52/389 X 3,646,180 2/1972 Winnick ..... 52/388 X 4,307,140 12/1981 Davis ..... 52/389 X

FOREIGN PATENT DOCUMENTS 291399 11/1967 Australia ..... 52/389

*Primary Examiner*—J. Karl Bell

*Attorney, Agent, or Firm*—Stevens, Davis, Miller & Mosher

[57] ABSTRACT

A building block for constructing a floor or wall has a plurality of tile blocks bonded to a single synthetic resin base. Pieces of acoustical insulating material are dispersed in the resinous base and a strip or sheet substantially impermeable to the resin is placed between the resin base and tile blocks bridging the interface between edges of adjacent tile blocks to regulate flow of the base material into interface between the tile blocks.

10 Claims, 3 Drawing Figures

FIG. 1
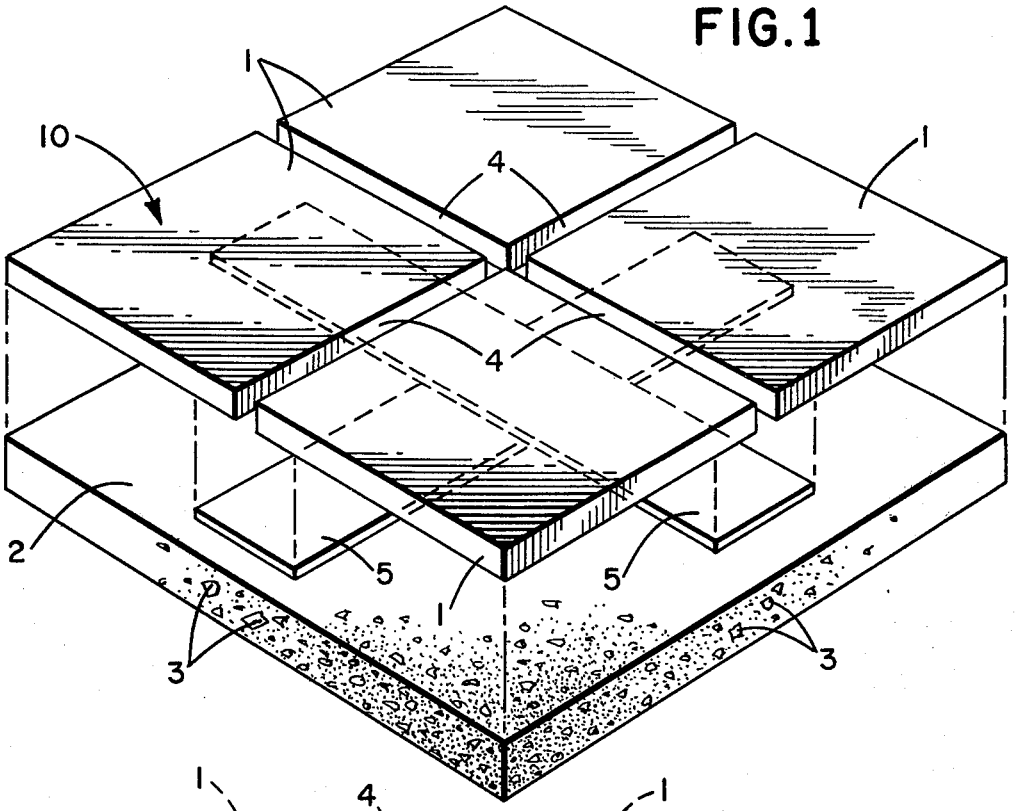
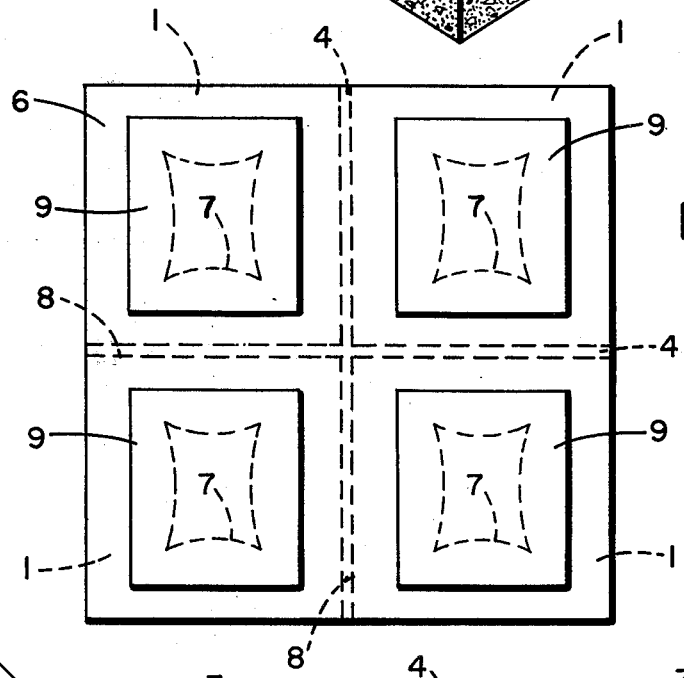
FIG. 2
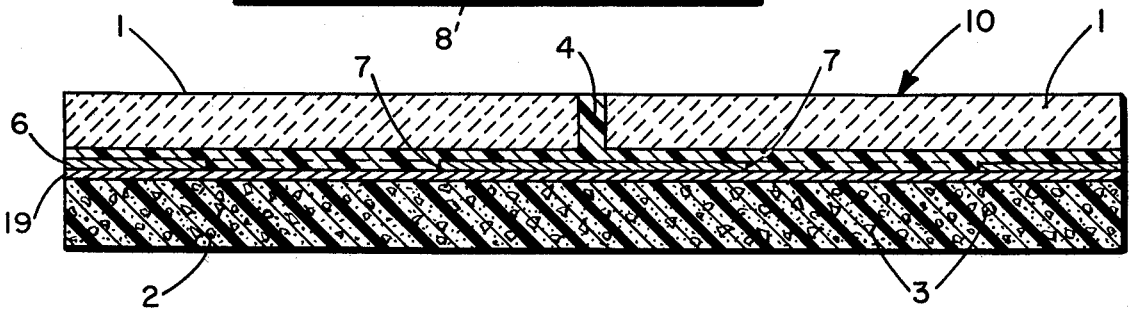
FIG. 3

BUILDING BLOCK FOR FLOORS AND WALLS OF A BUILDING

This invention relates to a building block for constructing a floor or the like, of a building and, in particular, to such a block having improved acoustical insulating properties.

In the installation of floors, or wall-coverings, disadvantages arise when the floors or wall-coverings are formed of tile blocks.

In fact, for providing good acoustical insulation characteristics to tile block floors which are ordinarily excellent sound conductors, it is necessary to lay a layer of acoustical insulation under the tile surface.

The required preparation of the substrate prior to laying of the tile block surface, adds to the time consuming installation of the single tile blocks with accompanying increased installation cost.

To solve this problem, it has been proposed to join mechanically several tile blocks together by means of an underlayer of synthetic material, such as, for example, an underlayer of an adhesive material. This method has, however, only reduced the installation time, but has not reduced the problem caused by the high noise conductivity of the tile blocks.

An object of the invention is to provide blocks having tile surfaces which are adapted to be assembled to form a tile surfaced floor, wall or the like, which blocks can be assembled or laid in substantially less time than is required to lay a tile floor with separate single tile blocks. Another object of the invention is to provide a tile surfaced block or panel having a plurality of single tile blocks forming the surface thereof bonded to a synthetic base in which the resin of the base does not exude or otherwise flow to the exposed surface of the floor between the facing edges of the tile blocks after they have been assembled to form the tile surface. Still another object of the invention is to provide an improved method of assembling tile blocks to form a floor or other wall surface and to improve the acoustical properties of the wall. A still further object of the invention is to provide a floor or the like which can be installed in a shorter time than is required to lay tile blocks individually on a subsurface to produce a wall or floor having improved acoustical properties and in which exudation of the subsurface to mar the appearance of the tile surface is prevented.

Other objects will become apparent from the following description with reference to the accompanying drawing wherein FIG. 1 is an exploded, perspective view of one embodiment of the invention;

FIG. 2 is a plan view illustrating the top or exposed surface of the embodiment of FIG. 1; and FIG. 3 is a section of a second embodiment of the tile surfaced block provided by the invention.

The foregoing objects and others are accomplished in accordance with the invention, generally speaking, by providing a block or panel having one surface covered with an assembly of tile blocks bonded to a synthetic resin substrate having pieces of acoustical insulating material distributed therein and a barrier against flow of the substrate to the tile surface when the block forms a part of a treading surface of a floor or the exposed surface of a wall panel, or the like. The acoustical insulation is preferably also a thermal insulating material. The invention thus contemplates a floor or other wall comprising a plurality of blocks having a treading surface covered with side by side tile blocks mounted on a synthetic resin base which is substantially free from imperfections caused by flow of the synthetic resin of the base upwardly through the interface between neighboring tile blocks and having improved acoustical characteristics over a conventional tile surface.

The improved acoustical properties are imparted to the floor or the like, by shavings, fragments or cut-pieces of any suitable material which has improved acoustical properties over the acoustical properties of the surface tile blocks, such as, for example, a vulcanized elastomer, wood, cork, a mineral foam such as exploded mica (vermaculite) and pumice, or the like. Any suitable synthetic resin base may be used for the bonding of the surface tile blocks thereto, such as, for example, a substantially non-porous polyurethane or a polyurethane foam, or the like, preferably a microporous or microcellular polyurethane foam of the kind disclosed in the book, "Polyurethanes: Chemistry & Technology" by Saunders and Frisch, published by Interscience Pub., Copyright 1964, Library of Congress Cat. #62-18932.

The invention thus provides a tile surfaced block for use as a module or unit for assembly to form a floor or other wall of a building having an exposed surface comprising a plurality of tile blocks bonded side by side to a synthetic resin base that simultaneously solves the problem of acoustic insulation and the problem of fabrication time, and as added advantages provides good thermal insulation from the ambient where it is installed and which does not present any traces of synthetic material on the visible surface of the tile blocks, independently of the spacing between adjacent tile blocks, provides excellent bonding of the tile blocks to the floor, the bonding being durable throughout the life of the floor, and which provides a good waterproof seal to the treading surface of the floor.

In a preferred embodiment of the invention, a tile surfaced block type floor is provided which has a plurality of tile blocks bonded to a surface of a layer of synthetic material, characterized by the fact, that the synthetic material layer comprises a resinous material with shavings or other particles of insulating material dispersed therein, and means for regulating the quantity of plastic material that is disposed between the edges of adjacent tile blocks.

In its more general concept, the module provided by the present invention has a plurality of tile blocks forming the visible side of the block bonded to the facing surface of a synthetic resin layer formed by a mixture comprising a resinous or plastic matrix with pieces of insulating material distributed therein and means for regulating the quantity of synthetic resin that becomes wedged between adjacent edges of the tile blocks.

In FIG. 1, one embodiment of the block provided by the invention is shown in a perspective exploded view. The block 10 has four smaller tile blocks 1 disposed side by side to form a substantially square block 10 as shown in FIG. 2. The blocks are assembled side by side on a sub-floor with their tiled surfaces exposed for the treading surface or the blocks are assembled to form a wall with the tiled surfaces exposed to provide a surface which is easily cleaned and has aesthetic properties.

Referring now to the drawing, tile blocks 1, are fixed to the surface of a base 2 of synthetic resin material to form a larger block 10 having four tile blocks 1, bonded side by side to base 2. In particular, base 2 is a microporous polyurethane foam having pieces 3 of cork dispersed substantially uniformly therein to improve the acoustical insulation of the block 10.

Alternatively, base 2 may be, for example, substantially non-porous polyurethane elastomer.

Preferably, the material from which the shavings are obtained, is also thermally insulating.

In the embodiment shown in FIG. 1, insulating embeddments 3 are cork. Moreover, in FIG. 1, one means 5 for regulating the quantity of plastic material that becomes wedged in the spaces between adjacent edges of tile blocks 1 is shown.

The means are continuous paper strips 5 placed astride spaces 4 between adjacent tile blocks 1. Continous strips 5 are placed on the side of tile blocks 1 facing base 2 of synthetic resin composition.

The width of strip 5 can be varied as function of the width of space 4 between adjacent tile edges. Moreover, strip 5 can be provided with an adhesive on its side facing the tile blocks to better control the passage of plastic material from base 2 to the surface of the block. The strip can be, according to an alternative embodiment of the invention, a particular form of a filtering means that prevent insulation 3 from migrating to between continuous strips 5 and tile blocks 1.

In FIG. 2, a second embodiment of means for regulating the quantity of plastic material that becomes wedged in the spaced between adjacent tile blocks is illustrated.

This means is a sheet 6 of paper having substantially rectangular shaped openings 7. Openings 7 are at least equal in number to the number of tile blocks and they are placed, preferably, in a central position with respect to tile blocks 1 (the edge of tile blocks 1 being indicated with the reference numeral 8) and they can assume the form shown, or else other forms for regulating in the desired manner, the quantity of resinous material that penetrates the openings 4 from base 2, even as a function of the number and the dimension of the tile blocks 1 associated to the block 10 provided by the present invention.

Connected to sheet 6, filtering means prevent pieces of insulation 3, from penetrating to between sheet 6 and tile blocks 1. The illustrated filtering means can be placed only correspondence of the openings 7, as shown in FIG. 2 and may be sheets 9 of a non-woven fabric placed on that side of sheet 6 that faces base 2 of sythetic resin. As an alternative to the single sheets of non-woven fabric 9, a single sheet having dimensions equal to about the dimensions of sheet 6, can be used. As an alternative to the non-woven fabric, the filtering means may be gauze, a netting, or be a large loop knit fabric that allows simultaneously, the passage of the liquid of the mixture (the plastic material) and holds back the solid part of the mixture (the insulation).

In FIG. 3, a cross-section of preferred embodiment of a flooring block according to the present invention is illustrated. FIG. 3, shows how the paper sheet 6, joined to the non-woven sheet 9, equal in dimensions to those of sheet 6, allows a complete filling-up of the spaces 4 between the edges of adjacent tile blocks 1 by the plastic material of base 2 without any plastic covering the visible surface of tile blocks 1.

A further variation, according to the present invention of the means for regulating the quantity of plastic or resinous material that flows into the crack between adjacent tile blocks, contemplates that the sheet 6 is paper, is impregnated or sprinkled with a substance that varies the structure of the plastic material forming part of the mixture that forms base 2.

Should the plastic material of base 2 be polyurethane, the sheet 6 is impregnated, for example, with ammonia or with polyoil, in such a way to unbalance the proportions of the substances forming the polyurethane during its expansion against sheet 6. This retards foaming near sheet 6, and hence, in expanding, the polyurethane foam does not fill spaces 4, or if it does, it penetrates the space only to a limited extent.

This particular embodiment is especially well suited, but not exclusively, for those cases where the tile blocks 1 have to be as close as possible to one another, and consequently, spaces 4 tend to be very narrow and hence, they tend to be almost nonexistent.

The resinous material of base 2 thus unbalanced by the impregnated agent of sheet 6, will tend to form adhesive that further increase the bonding between the tile blocks 1 and the base 2.

In a further alternative embodiment of the invention. the sheet comprises stiffening-means placed substantially in correspondence of the side of base 2 that is farthest from tile blocks 1. The stiffening means can be, for example, a net or a fabric.

The flooring block of the present invention may be made in the following way. In particular referring to the embodiment shown in FIG. 3, the block is made as follows:

Tile blocks 1 are placed in a mold of appropriate size and shape with their side forming the treading surface in contact with the base of the mold.

On the tile blocks 1 are placed paper sheet 6 provided with openings 7 centered with respect to the center of the tile blocks 1. Sheet 9 of non-woven fabric is then positioned in the mold. In another embodiment, sheet 6 and sheet 9 of non-woven fabric are placed in the mold simultaneously after they are doubled and bonded together.

The mixture of plastic material and insulating pieces 3 is poured into the mold.

The resin mixture can also be prepared in the mold by separately pouring the pieces of insulation 3 and the polyurethane reaction mixture or other resinous composition into the mold. The mold is closed and the foaming composition is permitted to expand.

The plastic composition disposed in the mold under sheet 6, while expanding fills the spaces 4 without covering the treading surface of the tile blocks 1, and at the same time bonds them to the base 2 that is being formed.

From the previous description, it can be seen how the objects of the invention are accomplished. In fact, the blocks provided by the invention solve at the same time both, the installation problem and the problem of providing acoustic and thermal insulation. In fact, in laying a single block, several tiles are layed at the same time, thus reducing construction time. At the same time that the tile blocks are layed down, the acoustic and thermal insulation contained in the base 2 are provided. Moreover, by using cork frangments as the insulation, light weight blocks are provided without substantial increase in weight, or, if blocks of equal dimensions are used, the blocks insulated with cork are lighter than those insulated with heavier insulation.

However, in both these instances, the laying operation of the floor or the covering of a wall is facilitated.

Moreover, because of control of the quantity of resin flowing downwardly between the tile blocks and to the blocking of flow of the insulation to between the tile blocks, a surface free from inperfection is obtained except for that which fills the spaces between adjacent tile blocks and the resin between blocks is sufficient to completely fill the spaces. Moreover, because of the bond between the resin of the base 2 and the sides of the tile blocks in contact therewith, an excellent bond of the tile blocks to the base is obtained and lasts throughout the lifetime of the floor. Moreover, the resin in the cracks between the tile blocks guarantees the continuity of the surface of the blocks so as to provide a floor which is substantially impermeable by liquids on the floor surface.

Although, the invention has been illustrated and described in detail for the purpose of illustration, variations can be made therein by those skilled in the art without departing from the spirit and scope of the invention except as it may be limited by the claims.

What is claimed is:

1. A building block for laying a floor or wall comprising a plurality of tile blocks bonded to a surface of a synthetic resin base, characterized by the fact that said base comprises a mixture of resin and pieces of acoustical insulation dispersed therein, and means for regulating the quantity of base material which flows to between adjacent edges of the tile blocks, said means for regulating the quantity of resin composition between the adjacent edges of the tile blocks being a paper sheet disposed between the base and the tile blocks having a hole therein centered below each tile block.

2. A building block for laying a floor or wall comprising a plurality of tile blocks bonded to a surface of a synthetic resin base, characterized by the fact that said base comprises a mixture of resin and pieces of acoustical insulation dispersed therein, and means for regulating the quantity of base material which flows to between adjacent edges of the tile blocks, and comprising means for blocking said pieces of insulation from flowing with synthetic resin from the base to between adjacent tile blocks along with the regulated quantity of resin that flows to between adjacent tile blocks, said means for blocking flow of said pieces of insulation from flowing with resin to between tile blocks being a non-woven fabric.

3. The block of claim 1 or 2, characterized by the fact that said base is a composition containing a polyurethane resin.

4. The block of claim 1 or 2, characterized by the fact that said means for regulating the quantity of resin material that flows from the base to between tile blocks comprises a matrix impregnated with a material which retards foaming of the resin adjacent to said means.

5. Tile-surfaced block for assembly to form a wall or floor comprising a plurality of tile blocks arranged on the surface thereof to form a substantially continuous surface of exposed tile blocks and bonded to an underlying synthetic resinous base having acoustical insulation dispersed therein and a sheet impervious to said resinous base bridging adjacent edges of the tile blocks fixed in position between the tile blocks and base to retard flow of the base to between adjacent edges of the tile blocks, said impervious sheet being disposed with rectangularly shaped holes therethrough centered below each tile block, and a non-woven fabric being disposed on the impervious sheet bridging the adjacent edges of the tile blocks to prevent the insulation pieces from becoming lodged between edges of the tile blocks.

6. The block of claim 1 wherein the tiles are ceramic, rubber or plastic blocks, the base is a microporous polyurethane resin, the insulation is cork and the sheet is paper.

7. The block of claim 6 wherein the paper sheet is formed of a plurality of paper strips.

8. Tile-surfaced blocks for use as a module to form a floor or a wall, said module comprising a plurality of tile blocks arranged on the surface thereof to form a substantially continuous surface of exposed tile blocks and bonded to an underlying synthetic resinous base having acoustical insulation dispersed therein, and sheets impervious to said resinous base bridging adjacent edges of the tile blocks fixed in position between the tile blocks and base to retard flow of the base to between adjacent edges of the tile blocks, wherein said sheets are strips of paper, a non-woven fabric being disposed on the sheets bridging the adjacent edges of the tile blocks, said base filling the space between adjacent tile blocks without covering the visible surface.

9. A building block for laying a floor or wall comprising a plurality of tile blocks bonded to a surface of a synthetic resin base, characterized by the fact that said base comprises a mixture of resin and pieces of acoustical insulation dispersed therein, and means for regulating the quantity of base material which flows to between adjacent edge of the tile blocks, and comprising means for blocking said pieces of insulation from flowing with synthetic resin from the base to between adjacent tile blocks along with the regulated quantity of resin that flows to between adjacent tile blocks, said means for regulating the quantity of resin composition between the adjacent edges of the tile blocks being a paper sheet disposed between the base and the tile blocks having a hole therein centered below each tile block.

10. A method for constructing a modular block for forming a wall of a building having a tile surface to be exposed on the wall which comprises disposing in a mold having a bottom a plurality of tile surfaced blocks with the tile surfaces against said bottom, placing on the resulting assembly of tile surfaced blocks at least one sheet substantially impervious to flow of liquid downwardly to the space between adjacent tile surfaced blocks and capable of regulating the volume of the liquid flowing into said space, covering said spaces with a non-woven fabric, pouring a synthetic resin having pieces of acoustical insulation dispersed therein into the mold over the thus produced assembly and allowing the resin to harden.

* * * * *